US009337576B2

(12) United States Patent
Masuda

(10) Patent No.: US 9,337,576 B2
(45) Date of Patent: May 10, 2016

(54) FLOATING CONNECTOR AND IMAGE FORMING APPARATUS

(71) Applicant: Brother Kogyo Kabushiki Kaisha, Nagoya (JP)

(72) Inventor: Takehiro Masuda, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/669,394

(22) Filed: Mar. 26, 2015

(65) Prior Publication Data

US 2015/0280364 A1 Oct. 1, 2015

(30) Foreign Application Priority Data

Mar. 31, 2014 (JP) ..... 2014-072709

(51) Int. Cl.
*G03G 15/00* (2006.01)
*H01R 13/631* (2006.01)
*G03G 21/16* (2006.01)

(52) U.S. Cl.
CPC ..... *H01R 13/6315* (2013.01); *G03G 21/1647* (2013.01); *Y10T 403/1616* (2015.01)

(58) Field of Classification Search
CPC ..... G03G 21/1842
See application file for complete search history.

(56) References Cited

U.S. PATENT DOCUMENTS

2006/0105603 A1 5/2006 Nishio et al.
2007/0237541 A1* 10/2007 Johnson ..... G03G 15/231 399/107
2009/0264008 A1 10/2009 Matsuda et al.
2012/0040553 A1* 2/2012 Tashiro ..... H01R 4/70 439/359

FOREIGN PATENT DOCUMENTS

JP H09-114170 A 5/1997
JP 2001-079792 A 3/2001
JP 2006-147305 A 6/2006
JP 2009-259682 A 11/2009

* cited by examiner

*Primary Examiner* — Roy Y Yi
(74) *Attorney, Agent, or Firm* — Burr & Brown, PLLC

(57) ABSTRACT

A floating connector, including a connector, a holder configured to support the connector, a retainer configured to retain the holder floating, and an urging member configured to urge the holder, is provided. The retainer includes a retainer-side positioning section. The holder includes a holder-side positioning section, which is configured to locate the holder in a predetermined position with respect to the retainer by contacting the retainer-side positioning section. The holder-side positioning section of the holder is urged by the urging member to contact the retainer-side positioning section of the retainer.

18 Claims, 8 Drawing Sheets

FLOATING CONNECTOR AND IMAGE FORMING APPARATUS

CROSS REFERENCE TO RELATED APPLICATION

This application claims priority from Japanese Patent Application No. 2014-072709 filed on Mar. 31, 2014, the entire subject matter of which is incorporated herein by reference.

BACKGROUND

1. Technical Field

An aspect of the present invention relates to a floating connector and an image forming apparatus with the floating connector.

2. Related Art

A floating connector including a holder to hold a connector and a retainer to maintain the holder floating is known. The floating connector may include a coil spring arranged between the holder and the retainer so that the coil spring may provide a resilient force to allow the holder to move with respect to the retainer to some extent in a direction of the resilient force and a direction orthogonal to the resilient force. Therefore, when the connector is to be connected with a mating connector, a positional difference between the two connectors may be remedied by the connecter being moved within the extent.

SUMMARY

According to the above configuration, however, the connector supported by the holder may move loosely while waiting for the mating connector to be connected thereto. In other words, the connector being supported by the holder may wait for the mating connector in a position displaced from the mating connector. Therefore, it may be an obstruction for smooth connection between the two connectors.

According to an aspect of the present invention, a floating connector, including a connector, a holder configured to support the connector, a retainer including a retainer-side positioning section and being configured to retain the holder floating, and a urging member configured to urge the holder, is provided. The holder includes a holder-side positioning section and is configured to locate the holder in a predetermined position with respect to the retainer by contacting the retainer-side positioning section. The holder-side positioning section of the holder is urged by the urging member to contact the retainer-side positioning section of the retainer.

According to an aspect of the present invention, an image forming apparatus including a main body with an image forming unit, an optional unit configured to be attachable to the main body, and a floating connector, is provided. The floating connector includes a connector, a holder configured to support the connector, a retainer including a retainer-side positioning section and being configured to retain the holder floating, and an urging member configured to urge the holder. The holder includes a holder-side positioning section configured to locate the holder in a predetermined position with respect to the retainer by contacting the retainer-side positioning section. The holder-side positioning section of the holder is urged by the urging member to contact the retainer-side positioning section of the retainer. The floating connector is disposed on the optional unit.

BRIEF DESCRIPTION OF THE ACCOMPANYING DRAWINGS

DETAILED DESCRIPTION

Figure 1:
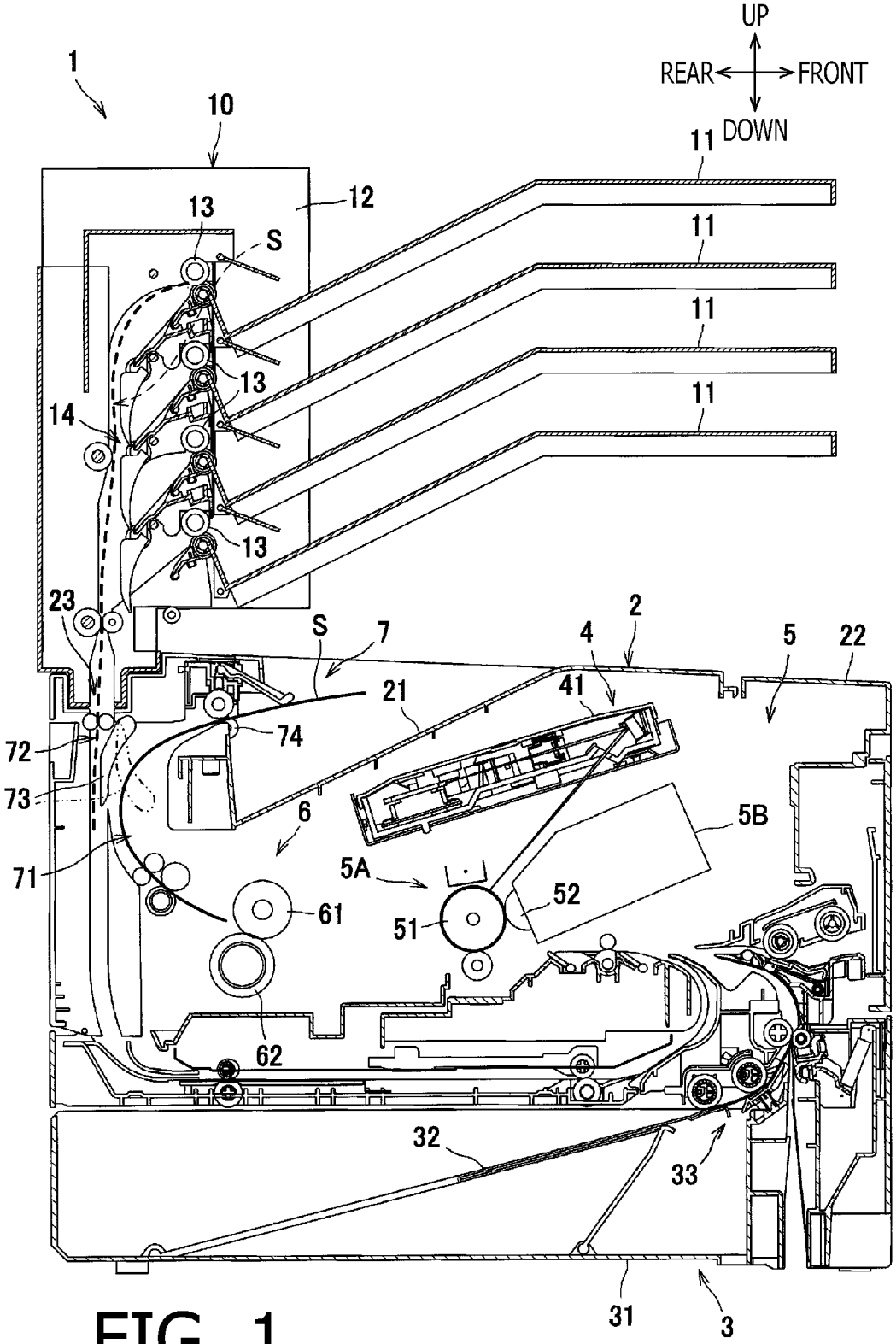
FIG. 1 is an illustrative cross-sectional side view of a laser printer with a sheet-exit unit according to an exemplary embodiment of the present invention.

Hereinafter, an exemplary configuration of a laser printer 1 according to an embodiment of the present invention will be described with reference to the accompanying drawings. In the following description, directions concerning the laser printer 1 will be referred to in accordance with a user's ordinary position to use the laser printer 1, as indicated by arrows in each drawing. For example, a viewer's right-hand side appearing in FIG. 1 is referred to as a front side of the laser printer 1, and a left-hand side in FIG. 1 opposite from the front side is referred to as a rear side. A side which corresponds to the viewer's nearer side is referred to as a left-hand side for the user, and an opposite side from the left, which corresponds to the viewer's farther side is referred to as a right-hand side for the user. An up-down direction in FIG. 1 corresponds to a vertical direction of the laser printer 1. Further, the right-to-left or left-to-right direction of the laser printer 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2-4, and 6 are similarly based on the orientation of the laser printer 1 as defined above and correspond to those with respect to the laser printer 1 shown in FIG. 1 even when the drawings are viewed from different angles.

The laser printer 1 is capable of forming images on a sheet S. The laser printer 1 includes, as shown in FIG. 1, a main body 2 and is attachable with a sheet-exit unit 10, which is an optional device to be used with the main body 2 of the laser printer 1. The sheet-exit unit 10 is attachable to a top part of the main body 2 when used in the laser printer 1.

The main body 2 includes a feeder unit 3, an image forming unit 4, and a conveyer unit 7. The main body 2 further includes a main sheet-outlet tray 21, on which the sheet S with the image formed thereon is placed, in an upper part thereof. The main sheet-outlet tray 21 is disposed in the upper position with respect to the image forming unit 4.

The feeder unit 3 is disposed in a lower position in the main body 2 and includes a feeder tray 31, a sheet-pressing plate 32, and a feeder device 33 including rollers to convey the sheets S.

The sheets S contained in the feeder tray 31 are uplifted to be picked up by the feeder device 33 and conveyed by the feeder device 33 toward the image forming unit 4.

The image forming unit 4 may serve to form the image on the sheets S being fed and is disposed in an upper position with respect to the feeder unit 3. The image forming unit 4 includes and exposure device 41, a processing cartridge 5, and a fixing unit 6.

The exposure device 41 is disposed in an upper position in the main body 2 and includes a laser emitter (not shown), polygon mirrors, lenses, and reflection mirrors, which may be shown but unsigned. In the scanner unit 4, a laser beam is emitted and transmitted to a surface of a photosensitive drum 51 in the processing cartridge 5 via the polygon mirrors, the lenses, and the reflection mirrors, which are unsigned, to scan the surface of the photosensitive drum 51.

The processing cartridge 5 is detachably attached to the main body 2 in a lower position with respect to the exposure device 41 through an opening (unsigned), which is exposed or covered by a front cover 22, while the front cover 22 is pivotable on a front side of the main body 2. The processing cartridge 5 includes a drum cartridge 5A and a developer cartridge 5B.

The drum cartridge 5A includes a photosensitive drum 51, on which an electrostatic latent image is formed, a charger, and a transfer roller, which may be shown but unsigned.

The developer cartridge 5B is detachably attached to the drum cartridge 5A and includes a developer roller 52, a supplier roller (unsigned), a toner-spreader roller (unsigned), and a toner container (unsigned) to contain a toner.

In the processing cartridge 5, as the photosensitive drum 51 rotates, a surface of the photosensitive drum 51 is electrically evenly charged by the charger and partly exposed to the laser beam emitted from the scanner unit 41 so that electrical charges of the exposed areas are lowered and a latent image according to image data is formed to be carried on the surface of the photosensitive drum 51. Meanwhile, the toner in the toner container of the developer cartridge 5B is supplied to the developer roller 52 through the supplier roller and enters a gap between the developer roller 52 and the toner-spreader blade to form an evenly-flattened layer on the developer roller 52.

The toner carried on the developer roller 52 is supplied from the developer roller 52 to the latent image formed on the photosensitive drum 51. Thus, the latent image is visualized and developed to be a toner image. In the meantime, as the sheet S is conveyed through a gap between the photosensitive drum 51 and the transfer roller, the toner image carried on the surface of the photosensitive drum 51 is transferred onto the sheet S.

The fixing device 6 is disposed in a rearward position with respect to the processing cartridge 5 and includes a heat unit 61 with a heater (not shown) and a pressure roller 62, which nips the sheet S in a position between the heat unit 61 and the pressure roller 62. In the fixing device 6, the toner image transferred to the sheet S is thermally fixed thereon as the sheet S passes through the gap between the heat unit 61 and the pressure roller 62.

The conveyer unit 7 includes an in-body exit path 71, an outlet path 72, a flapper, and an exit roller 74. The in-body exit path 71 is a pathway to guide the sheet S having been conveyed through the fixing device 6 to the main sheet-outlet tray 21. The outlet path 72 is a pathway diverging from the in-body exit path 71. The flapper 73 is disposed at a diverging point, at which the outlet path 72 diverges from the in-body exit path 71. The exit roller 74 is disposed at an exit of the in-body exit path 71.

The outlet path 72 is formed to guide the sheet S through a slit 23, which is formed at a rearward position on the top surface of the main body 2, to the sheet-exit unit 10.

The flapper 73 is swingably attached to the main body 2 to swing frontward and rearward. The flapper 73 is moved to swing rearward to close the outlet path 72, as indicated by solid lines in FIG. 1, to guide the sheet S being conveyed in the in-body exit path 71 to the exit roller 74. When the flapper 73 is moved to swing frontward to close the in-body exit path 71, as indicated by double-dotted lines in FIG. 1, the sheet S being conveyed in the in-body exit path 71 is guided to the outlet path 72.

Thus, in the conveyer unit 7, when the sheet S is to be guided to the main sheet-outlet tray 21, the flapper 73 is moved to swing rearward so that the sheet S having been conveyed through the image forming unit 4 is conveyed in the in-body exit path 71 and conveyed by the exit roller 74 to the main sheet-outlet tray 21. Meanwhile, when the sheet S is to be guided to the sheet-exit unit 100, the sheet S having been conveyed through the image forming unit 4 is guided through the in-body exit path 71 to the outlet path 72 and conveyed through the slit 23 to the sheet-exit unit 10.

The sheet-exit unit 10 includes a plurality of optional trays 11, a chassis 12, a plurality of exit rollers 13, and an exit-unit paths 14. The optional trays 11 are arranged to align vertically, and the chassis 12 support the optional trays 11. The exit rollers 13 are arranged to correspond to each of the optional trays 11 respectively. The exit-unit path 14 is continuous with the outlet path 72 through the slit 23, and the sheet S conveyed out of the main body 2 is further conveyed to one of the exit rollers 13 through the exit-unit path 14.

In the sheet-exit unit 10, the sheet S having been conveyed out of the main body 2 through the slit 23 is guided in the exit-unit path 14 to a designated one of the optional trays 11.

Figure 2:
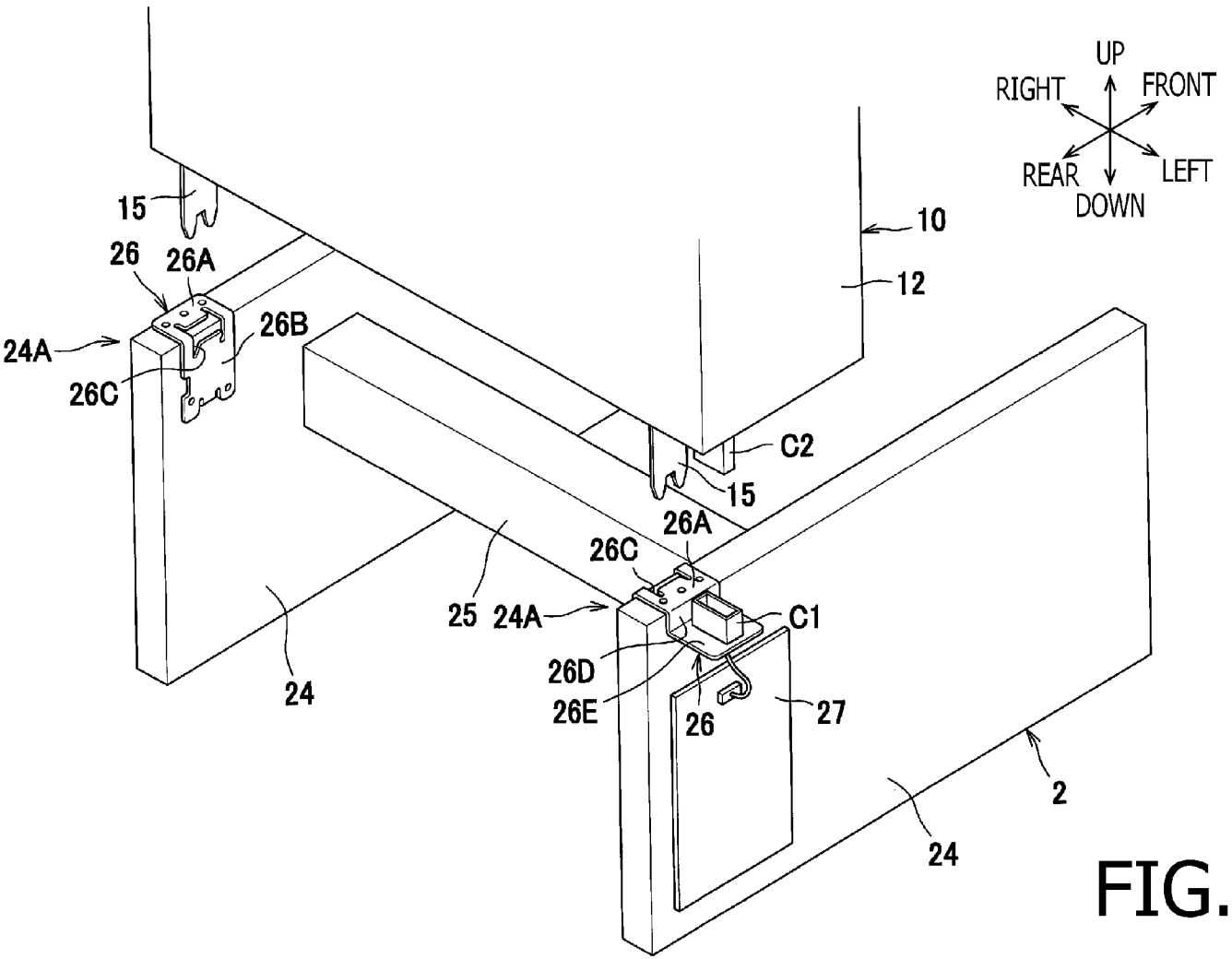
FIG. 2 is an exploded view of a part of the laser printer, including a pair of lateral frames, brackets, on-body connectors, and the sheet-exit unit, according to the exemplary embodiment of the present invention.

Next, a configuration of the laser printer 1 to attach the sheet-exit unit 10 to the main body 2 will be described in detail. As shown in FIG. 2, the main body 2 includes paired lateral frames 24. The sheet-exit unit 10 is placed on rear portions of the paired lateral frames 24.

The paired lateral frames 24 are made of resin and arranged to face each other across the image forming unit 4 along the widthwise direction. The paired lateral frames 24 are coupled to each other by a coupling member 25, which is disposed to extend between the lateral frames 24. The coupling member 25 may be, for example, a part of a guide, which forms an exit path in the image forming unit 4 to guide the sheet S, or a part of a supporting member, which supports the exposure device 41.

Each lateral frame 24 is formed to have a placement section 24A, on which the sheet-exit unit 10 is placed, at an upper face of the rear portion. On each placement section 24A, arranged is a bracket 26. Therefore, the placement section 24A and the bracket 26 of each lateral frame 24 form a part of the main body 2, to which the sheet-exit unit 10 is fixed. Meanwhile, on one of the brackets 26 arranged over the lateral frame 24 on the left, disposed is an on-body connector C1.

Each bracket 26 is a metal-made piece and is fixed to the lateral frame 24 by, for example, a screw (not shown). The bracket 26 includes a first covering part 26A and a second covering part 26B. The first covering part 26A is placed to overlap a part of the upper face of the lateral frame 24 of the main body 2 vertically, and the second covering part 26B is formed to extend downward from an end of the first covering part 26A to overlap an inner face of the lateral frame 24 along the widthwise direction. The bracket 26 is further formed to have an opening 26C at an edge between the first covering part 26A and a second covering part 26B. In other words, a rim of the opening 26C is formed by the bracket 26.

The bracket 26 placed on the lateral frame 24 on the left further includes a third covering part 26D and a connector-fixing part 26E. The third covering part 26D is formed to extend downward from the other end, i.e., an outer end, of the first covering part 26A opposite from the second covering part 26B. To the connector-fixing part 26E, fixed is the on-body connector C1, which is connected to a circuit board 26 disposed in the main body 2.

Meanwhile, the sheet-exit unit 10 includes a pair of inserting members 15, which are arranged on the right and left sides of the sheet-exit unit 10 to protrude downward from a lower face of the chassis 12, so that the pair of inserting members 15 are inserted in the openings 26C arranged in the main body 2 to be engaged with the brackets 26. Thus, with the engagement of the inserting members 15 with the brackets 26, the sheet-exit unit 10 is placed in a correct position with respect to the main body 2 in the front-rear direction and the widthwise direction.

The sheet-exit unit 10 is provided with an exit-unit connector C2, which is mutually connectable with the on-body connector C1. The exit-unit connector C2 is disposed in an outward position with respect to the inserting member 15 on the left to align with the pair of inserting members 15 along the widthwise direction. In other words, the pair of inserting members 15 and the exit-unit connector C2 are arranged to align in line along the widthwise direction.

Figure 3:
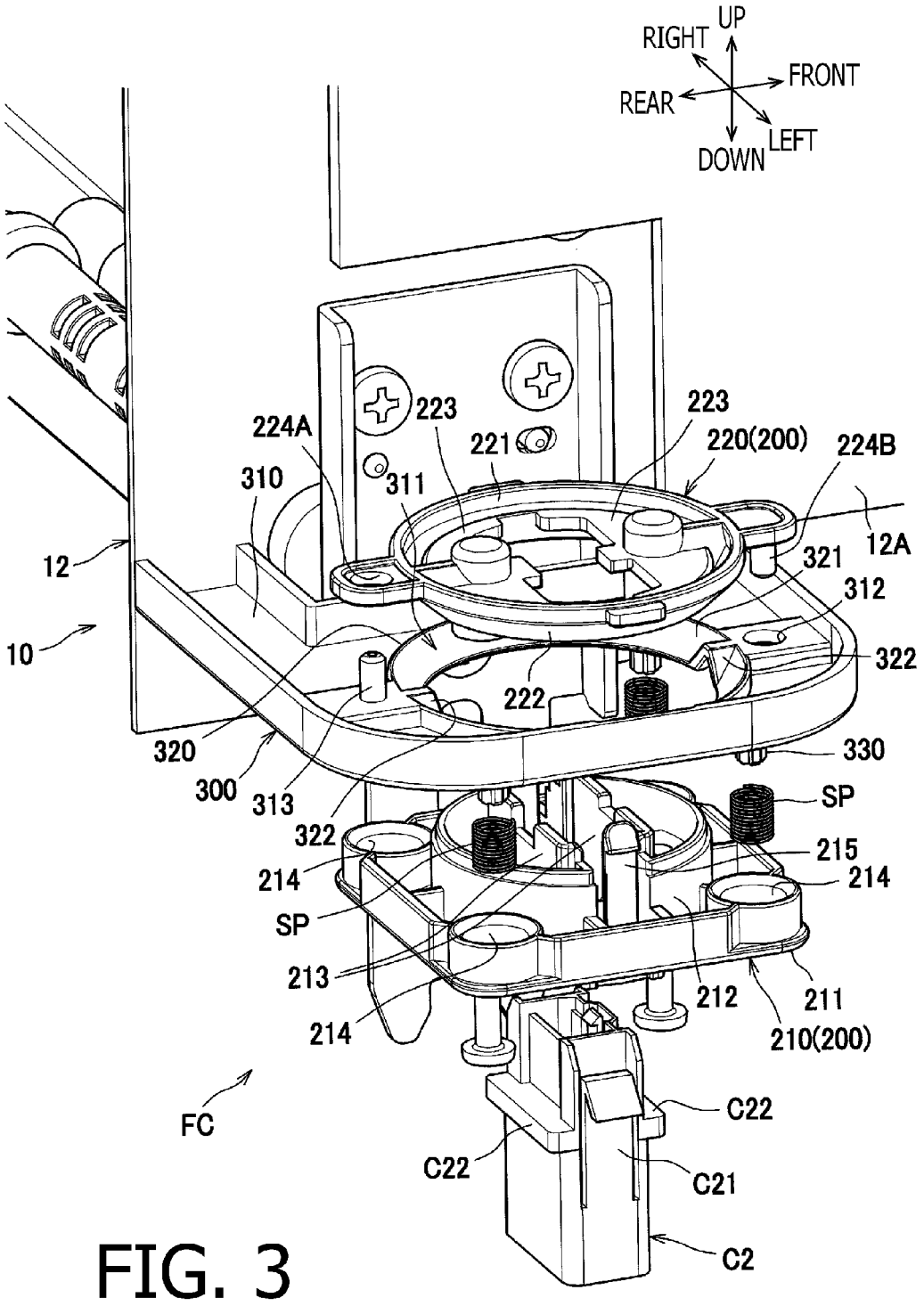
FIG. 3 is an exploded view of a floating connector in the laser printer according to the exemplary embodiment of the present invention.

As shown in FIG. 3, the exit-unit connector C2 is a part of a floating connector FC, which is disposed on the sheet-exit unit 10.

The floating connector FC is a connector unit which supports the exit-unit connector C2 movably so that the exit-unit connector C2 may be moved to meet with a position of the on-body connector C1. The floating connector FC includes a holder 200, which holds the exit-unit connector C2, and a retainer 300, which retain the holder 200 floating, i.e., to be movable within a certain range in the vertical and horizontal directions. The holder 200 includes a first piece 210 and a second piece 220, between which the retainer 300 is interposed along the vertical direction. Therefore, the first piece 210 and the second piece 220 are arranged to enclose the retainer 300 in there-between along the vertical direction. In other words, the holder 200 is arranged on both sides of the retainer 300 along the vertical direction. Between the first piece 210 of the holder 200 and the retainer 300, arranged are compression springs SP which provide resiliency.

The retainer 300 is disposed on the chassis 12 of the sheet-exit unit 10 and extends outward along the widthwise direction from a lower end of a left-side wall of the chassis 12. The retainer 300 includes a main part 310, which stretches horizontally, and has an opening 311, which is formed through the main part 310 vertically, in an approximately central position in the main part 310. Along a rim of the opening 311, formed is a retainer-side positioning section 320. The main part 310 of the retainer 300 includes a first hole 312, which is formed in a frontward position with respect to the retainer-side positioning section 320, and a first projection 313, which is a boss formed in a rearward position with respect to the retainer-side positioning section 320 to protrude upward.

The retainer-side positioning section 320 includes a first slope 321, which is a surface inclined with respect to the vertical direction and encircle the opening 311 in a ring shape. The first slope 321 forms a tapered surface, which inclines inward toward a center of the opening 311 as the first slope 321 extends downward.

The retainer-side positioning section 320 is provided with retainer-side engageable parts 322, which are formed to protrude obliquely upward from the first slope 321, in positions along the front-rear direction across the center of the opening 311. Each retainer-side engageable part 322 is formed in a shape of an inverted V, which points upward.

The retainer 300 is further formed to have a plurality of, e.g., four, spring-support projections 330, which project downward and are arranged at an approximately equal interval along a rim of the retainer-side positioning section 320. In FIG. 3, some of the four spring-support projections 330 are shown (see also FIG. 5).

Meanwhile, the first piece 210 of the holder 200 is arranged in a lower position with respect to the retainer 300. The first piece 210 includes a base 211, which spreads horizontally, a cylinder 212, which protrudes upward from an upper plane of the base 211, a pair of partitions 213, which are arranged inside the cylinder 212 to stand on the base 211, and a plurality of spring supports 214, which project upward from the upper plane of the base 211 around the cylinder 212.

The cylinder 212 is divided into two semicircular parts, which face each other along the widthwise direction, and a pair of hooks 215 are arranged at gaps formed between the two semicircular parts.

Figure 4:
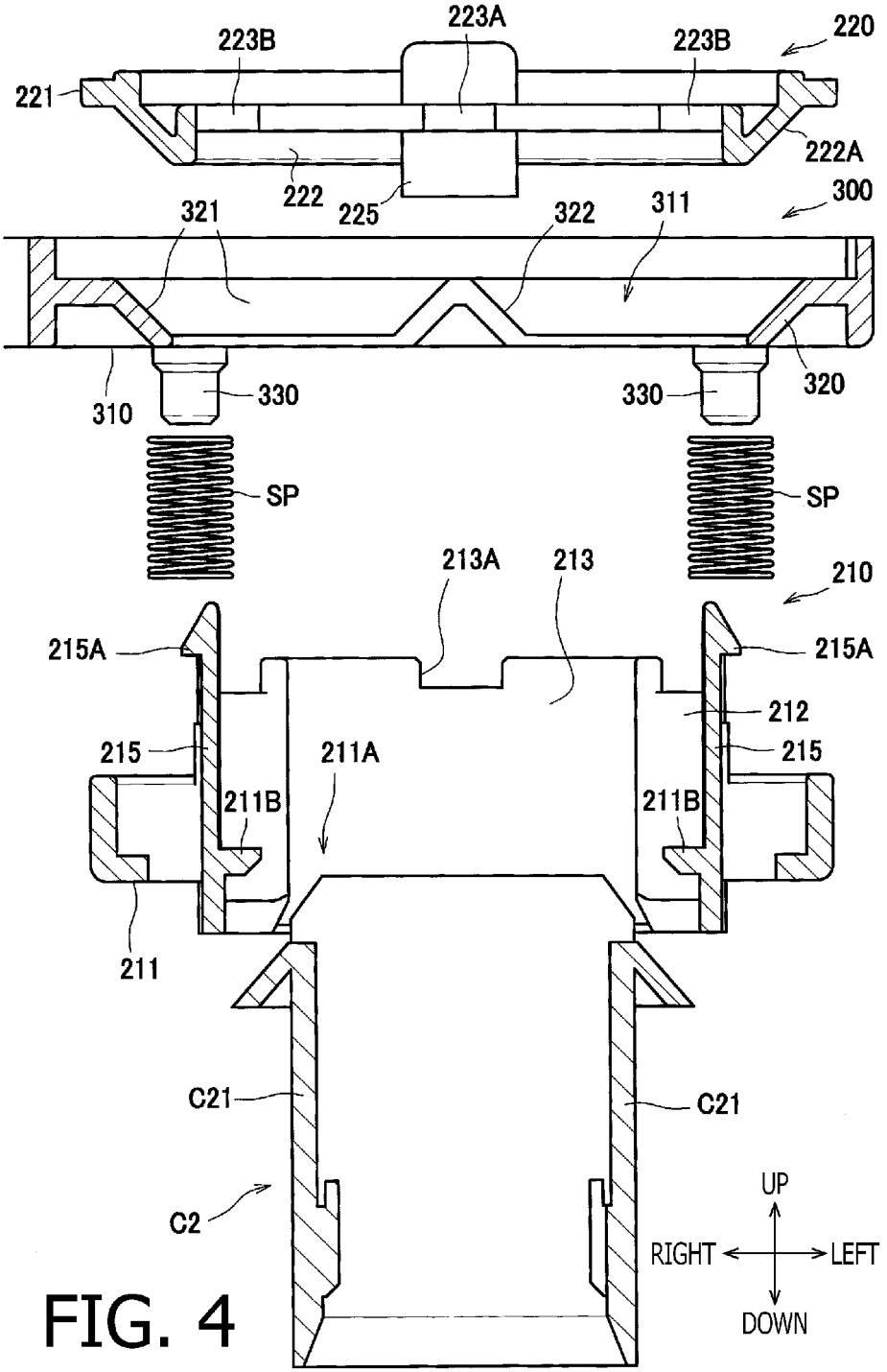
FIG. 4 is a cross-sectional view of parts in the floating connector of the laser printer, taken at a center of an exit-unit connector along a plane orthogonal to a front-rear direction, according to the exemplary embodiment of the present invention.

As shown in FIG. 4, each hook 215 is formed to extend upward from the base 211, and upper ends of the hooks 215 are arranged in upper positions with respect to an upper edge of the cylinder 212. Each hook 215 is formed to have an engageable portion 215A, which protrudes outward along the widthwise direction, at the upper end thereof. The cylinder 212 and the hooks 215 are formed in substantial sizes to be arranged inside the opening 311 of the retainer 300.

As shown in FIG. 3, the pair of partitions 213 are in an arrangement to face with each other along the front-rear direction with the hooks 215 interposed there-between. Each partition 213 is formed to have an engageable dent 213A (see FIG. 4), which dents downward, in a central position along the widthwise direction on an upper edge thereof.

The base 211 is formed to have a hole 211A in a position between the paired partitions 213. The hole 211A bores through the base 211 vertically, and the exit-unit connecter C2 may be arranged to penetrate through the hole 211A. On an inner circumference of the hole 211A, formed are a pair of engageable projections 211B, which project inward along the widthwise direction.

Figure 7:
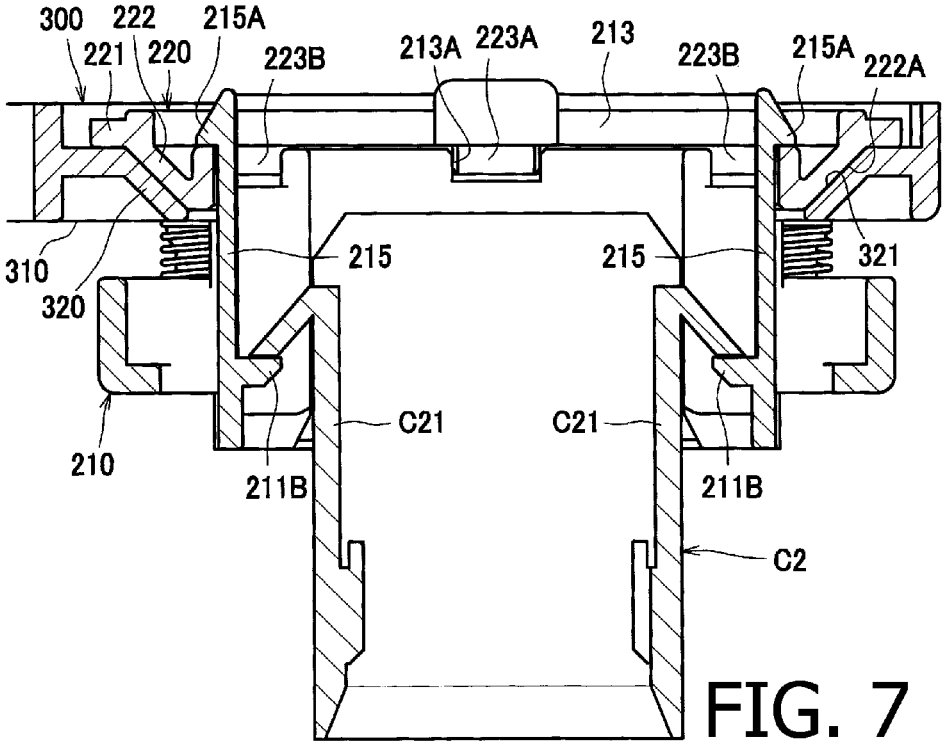
FIG. 7 is a cross-sectional view of the floating connector in the laser printer, taken at the center of the exit-unit connector along the plane orthogonal to the front-rear direction, according to the exemplary embodiment of the present invention.

Next, the configuration of the exit-unit connector C2 will be described herein in detail. The exit-unit connector C2 is formed in a shape of a four-sided sleeve and has a hook C21 on each of right and left sides of the sleeve. Each of the hooks C21 is provided with a claw (unsigned) at an upper end thereof. As shown in FIG. 7, when the claws of the hooks C21 are placed to engage with the engageable projections 211B of the first piece 210 from above, the exit-unit connector C2 may be restricted from moving downward with respect to the first piece 210.

Further, as shown in FIG. 3, the exit-unit connector C2 is formed to have a pair of flanges C22 on each of front and rear sides of the sleeve. Each flange C22 is formed to project along the front-rear direction and are elongated along the widthwise direction. When the pair of flanges C22 are placed to contact the pair of partitions 213 from below, the exit-unit connector C2 may be restricted from moving upward with respect to the first piece 210.

Figure 5:
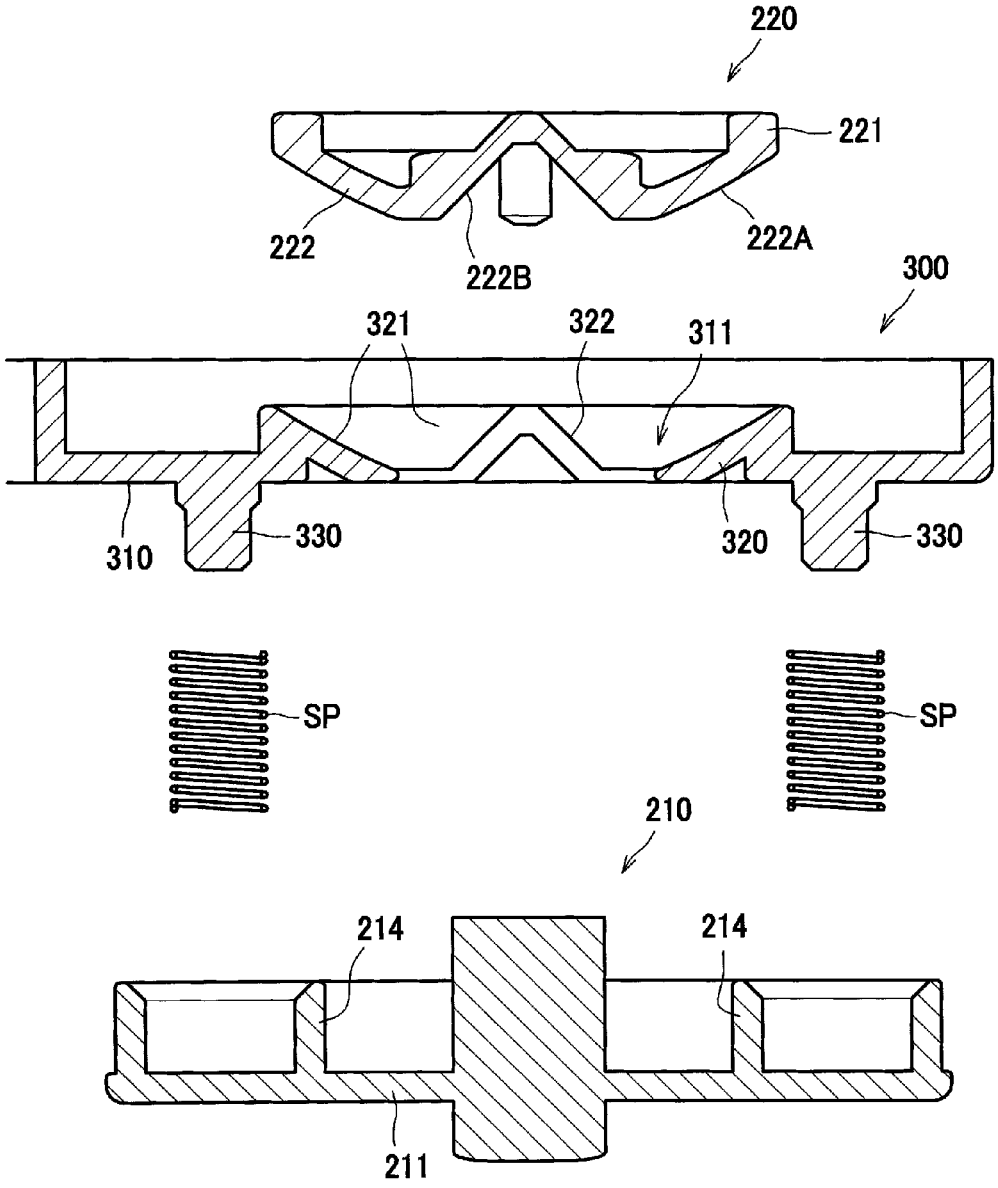
FIG. 5 is a cross-sectional view of the parts in the floating connector of the laser printer, taken at an on-holder engageable part along a plane orthogonal to the front-rear direction, according to the exemplary embodiment of the present invention.

Meanwhile, the spring supports 214 are arranged on each of four corners of the base 211. For example, as shown in FIG. 5, each spring support 214 is arranged in a lower position with respect to the spring-support projection 330 of the retainer 300 and is formed in a cylinder, which is in a substantial size to accommodate the compressed coil spring SP.

Figure 6:
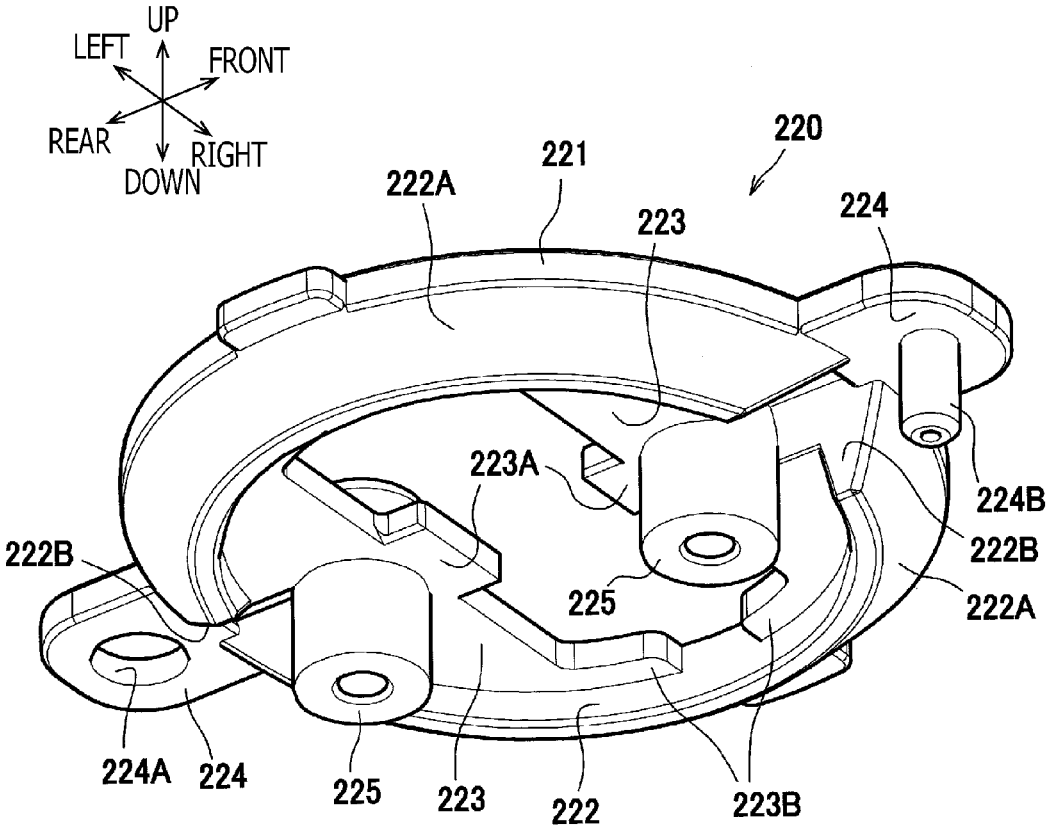
FIG. 6 is an upward perspective view of a holder of the floating connector in the laser printer according to the exemplary embodiment of the present invention.

The second piece 220 of the holder 200 is a piece which is placed on an upper side of the retainer 300. The second piece 220 includes, as shown in FIG. 6, a main part 221, a holder-side positioning section 222, a pair of first juts 223, and a pair of second juts 224. The main part 221 is in a ring shape, and the holder-side positioning section 222 is formed to hang downward from a lower side of the main part 221. The first juts 223 are formed to project inward from an inner periphery of the main part 221, and the second juts 224 are formed to spread outward from an outer periphery of the main part 221.

The holder-side positioning section 222 is formed in a ring shape that stretches downward from an edge of the outer periphery of the main part 221. An outer periphery of the holder-side positioning section 222 forms a second slope 222A, which is a surface inclining with respect to the vertical direction. The second slope 222A forms a tapered surface, which inclines inward toward a radial center of the main part 221.

As shown in FIG. 4, the second slope 222A is placed on an upper side of the first slope 321 of the retainer-side positioning section 320. In this regard, an angle of the second slope 222A with respect to the vertical direction is substantially equal to an angle of the first slope 321 with respect to the vertical direction.

Referring back to FIG. 6, the holder-side positioning section 222 includes two (2) holder-side engageable parts 222B, which dent inward from the second slope 222A at frontward and rearward positions. A shape of the holder-side engageable parts 222B should be substantially similar to the shape of the retainer-side engageable parts 322 of the retainer-side positioning section 320. In other words, the holder-side engageable parts 222B may be formed in a shape of an inverted V, which points upward.

As shown in FIG. 5, the holder-side engageable parts 222B are placed over the retainer-side engageable parts 322 of the retainer-side positioning section 320. In this regard, the holder-side engageable parts 222B are engageable with the retainer-side engageable parts 322 along a rotatable direction of the second piece 220, which may rotate about a center of the retainer-side positioning section 320, in the holder 200.

As shown in FIG. 6, each of the first juts 223 is a piece of plate jutting inward from a range smaller than a semicircle of the inner periphery of the main part 221. Each first jut 223 includes a first projection 223A, which projects inward toward the radial center of the main part 221, at a central position on a jutting edge thereof. Further, each first jut 223 includes a pair of second projections 223B, which are formed on each widthwise end of the first projection 223A to project from the jutting edge thereof toward the other first jut 223 in the second piece 220 (see also FIG. 4).

Each first jut 223 includes a screw-fixing part 225, which is in a form of a cylinder elongated vertically.

One of the second juts 224 arranged in the frontward position in the main part 221 includes a second projection 224B being a boss, which protrudes downward from a lower side of the second jut 224. The second projection 224B is in a size with a diameter which is substantially smaller than a diameter of the first hole 312 formed in the retainer 300.

The other one of the second juts 224 arranged in the rearward position in the main part 221 includes a second hole 224A, which is formed through the second jut 224 vertically. The second hole 224A is in a size with a diameter which is substantially larger than a diameter of the first projection 313 formed in the retainer 300.

In the holder 200 configured as above, as shown in FIG. 7, the hooks 215 in the first piece 210 penetrate through the opening 311 in the retainer 300 to be placed in a position between the mutually facing second projections 223B (see FIG. 6) of the second piece 220 while the engageable portions 215A are engaged with edges of the main part 221 of the second piece 220. Meanwhile, each first projection 223A in the second piece 220 is placed in each of the engageable dents 213A formed in the partitions 213 of the first piece 210 respectively. Thus, the first piece 210 and the second piece 220 are assembled together, with the retainer 300 interposed in there-between. In this regard, screws (not shown) inserted in through-holes (not shown) formed in the base 211 may be screwed into the screw-fixing parts 225 in the second piece 220 so that the first piece 210 is fixed to the second piece 220. Thereby, the first piece 210 and the second piece 220 are integrally movable.

Thus, while the second projections 224B in the second piece 220 are placed in the first holes 312 in the retainer 300, and while the first projection 313 in the retainer 300 is placed in the second hole 224A in the second piece 220, as shown in FIG. 3, the holder 200 may be restricted from being rotated substantially with respect to the retainer 300.

Meanwhile, the spring-support projection 330 of the retainer 300 are inserted in the compression springs SP, which are placed between the main part 310 of the retainer 300 and the spring supports 214 of the holder 200 in a compressed condition. The compression springs SP urge the first piece 210 in a direction to be farther from the retainer 300, i.e., downward with respect to the retainer 300, so that the holder-side positioning section 222 in the second part 220, which is movable integrally with the first piece 210, of the holder 200 should be placed to contact the retainer-side positioning section 320 in the retainer 300. In this regard, the compressed coil springs SP are arranged in positions to encircle the exit-unit connector C2, in a view along an urging direction of the compression springs SP, i.e., along the vertical direction.

According to the floating connector FC described above, it is noted that, when the sheet-exit unit 10 is not attached to the chassis 12 and when the exit-unit connector C2 is not subject to an external force, as shown in FIG. 7, the holder-side positioning section 222 in the holder 200 contacts the retainer-side positioning section 320 in the retainer 300.

When the holder-side positioning section 222 contacts the retainer-side positioning section 320, the second slopes 222A in the holder-side positioning section 222 and the first slope 321 of the retainer-side positioning section 320, which are both tapered at the equal inclination, fit with each other, and the holder-side positioning section 222 may slide to move along the first slope 321 of the retainer-side positioning section 320 toward the center of the opening 311 in the retainer 300 to be located in a predetermined position spontaneously. Thus, with the holder 200 being set in the predetermined correct position with respect to the retainer 300, when the sheet-exit unit 10 is attached to the main body 2, a positional gap between the exit-unit connector C2 and the on-body connector C1 may be reduced, and the exit-unit connector C2 may be connected to the on-body connector C1 more easily.

Figure 8:
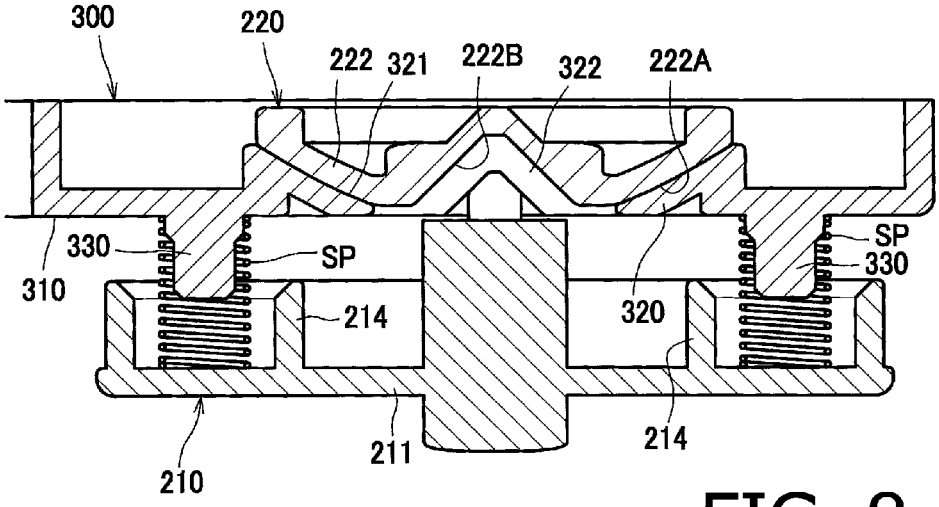
FIG. 8 is a cross-sectional view of the floating connector of the laser printer, taken at the on-holder engageable part along the plane orthogonal to the front-rear direction, according to the exemplary embodiment of the present invention.

Further, as shown in FIG. 8, while the retainer-side engageable parts 322 in the retainer-side positioning section 320 are engaged with the holder-side engageable parts 222B in the holder-side positioning section 222 along the rotatable direction of the holder 200 to rotate about the center of the retainer-side positioning section 320, an orientation of the exit-unit connector C2 with regard to the rotatable direction may be determined even when the sheet-exit unit 10 is not attached to the main body 2. Therefore, the exit-unit connector C2 may be connected to the on-body connector C1 more easily.

Meanwhile, the plurality of compression springs SP to urge the holder 200 are arranged in the positions to encircle the exit-unit connector C2 in the view along the urging direction of the compression springs SP. Therefore, the force to be applied from the on-body connector C1 to the exit-unit connector C2 may be absorbed in a preferable balance by the plurality of compression springs SP so that the exit-unit connector C2 may be prevented from tilting.

Further, as shown in FIG. 2, the exit-unit connector C2 is arranged to align with the paired inserting members 15, which are engaged with the brackets 26 on the main body 2. Therefore, when the sheet-exit unit 10 is attached to the main body 2, if the sheet-exit unit 10 approaches the main body 2 in a displaced orientation with regard to a line, on which the paired inserting members 15 align, the position of the exit-unit connector C2 may be prevented from being displaced largely from the on-body connector C1. Accordingly, the exit-unit connector C2 may be connected to the on-body connector C1 easily.

Further, when the sheet-exit unit 10 is being attached to the main body 2, and when the exit-unit connector C2 contacts the on-body connector C1, the holder 200 may float from the retainer 300 against the urging force of the compression springs SP. Thus, the holder 200 may move in the vertical and horizontal directions with respect to on-body connector C1. Accordingly, the positional gap between the exit-unit connector C2 and the on-body connector C1 may be remedied.

Further, when the sheet-exit unit 10 is detached from the main body 2, and the on-body connector C1 is disconnected from the exit-unit connector C2, the holder-side positioning section 222 is placed to contact the retainer-side positioning section 320. Therefore, the exit-unit connector C2 may return to the predetermined position.

Although an example of carrying out the invention has been described, those skilled in the art will appreciate that there are numerous variations and permutations of the laser printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

Figure 9:
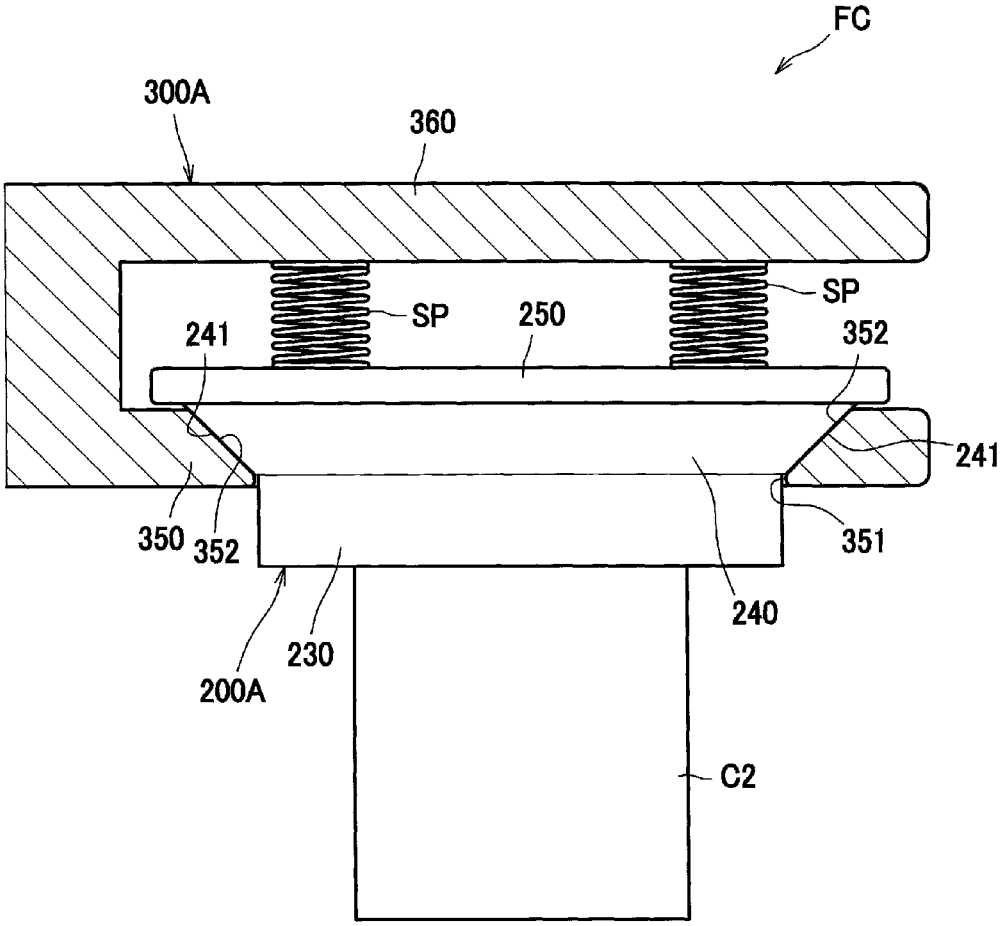
FIG. 9 is a cross-sectional view of a floating connector in a modified example according to the exemplary embodiment of the present invention.

For example, the floating connector FC may not necessarily be configured such that the holder 200 includes the first piece 210 and the second piece 220, to enclose the retainer 300 there-between, but may be configured, as shown in FIG. 9, such that a retainer 300A provides a third part 350 and a fourth part 360, which enclose a holder 200A there-between.

That is, for example, the third part 350 may be arranged on a side of the holder 200A closer to the exit-unit connector C2, i.e., a lower side of the holder 200A. Meanwhile, the fourth part 360 may be arranged on an opposite side of the holder 200A farther from the exit-unit connector C2, i.e., an upper side, at a position spaced apart from the third part 350. The third part 350 may have an opening 351 at a central position and a retainer-side positioning section 352 on a rim of the opening 351. The retainer-side positioning section 352 may provide a tapered surface, which inclines inward toward a center of the opening 351 as the retainer-side positioning section 352 stretches downward.

Meanwhile, the holder 200A may include a connector-holder 230, to which an exit-unit connector C2 is fixed, a holder-side positioning section 240 arranged on top of the connector-holder 230, and a flange 250 spreading outward from an upper end of the holder-side positioning section 240.

The connector-holder 230 is formed in a substantially smaller size than the opening 351 of the retainer 300A and vertically movable through the opening 351.

The holder-side positioning section 240 is formed to have a tapered slope, which fits with the retainer-side positioning section 352 from above, on an outer periphery thereof.

In positions between the fourth part 360 in the retainer 300A and the flange 250 in the holder 200A, two (2) compression springs SP may be arranged in a compressed condition. The compression springs SP may urge the holder 200A downward so that the holder-side positioning section 240 contacts the retainer-part positioning section 352. In this regard, the compressed springs SP may be arranged in positions, between which the exit-unit connector C2 is interposed, in a view along the urging direction of the compression springs SP, i.e., along the vertical direction.

With the floating connector FC configured as above, similarly to the floating connector FC in the previous embodiment, without an external force on the exit-unit connector C2, the slope 241 of the holder-side positioning section 240 in the holder 200A may contact the retainer-side connecting section 352 in the retainer 300, and the exit-unit connector C2 may slide to move along the retainer-side positioning section 352 toward the center of the opening 351 in the retainer 300. Thus, with the holder 200A being set in a predetermined position with respect to the retainer 300A, when the sheet-exit unit 10 is to be attached to the main body 2, a positional gap between the exit-unit connector C2 and the on-body connector C1 may be reduced, and the exit-unit connector C2 may be connected to the on-body connector C1 easily.

Further, with the two compression springs SP arranged in the positions, between which the exit-unit connector C2 is interposed in the view along the vertical direction, the force to be applied from the on-body connector C1 to the exit-unit connector C2 may be balanced in the two compression springs SP so that the exit-unit connector C2 may be prevented from tilting.

In the embodiment described above, the retainer-side positioning section 320 and the holder-side positioning section 222 are formed in circular shapes; however, the shape of the retainer-side positioning section 320 or the holder-side positioning section 222 may not necessarily be limited to round but may be in, for example, a polygonal opening.

For another example, both the retainer-side positioning section 320 and the holder-side positioning section 222 may not necessarily provide the slopes, which incline with respect to the urging direction of the compression springs SP, i.e., the vertical direction, but solely one of the retainer-side positioning section and the holder-side positioning section may provide a slope, which inclines with respect to the urging direction of the compression springs SP.

What is claimed is:

1. A floating connector disposed on an optional unit, the floating connector comprising:

a connector;

a holder configured to support the connector;

a retainer configured to retain the holder floating, the retainer comprising a retainer-side positioning section; and an urging member configured to urge the holder;

wherein the holder comprises a holder-side positioning section, the holder-side positioning section being configured to locate the holder in a predetermined position with respect to the retainer by contacting the retainer-side positioning section;

wherein the holder-side positioning section of the holder is urged by the urging member to contact the retainer-side positioning section of the retainer; and wherein one of the holder and the retainer is configured to be arranged on both sides of the other of the holder and the retainer along an urging direction of the urging member, and the one of the holder and the retainer that is arranged on both sides of the other of the holder and the retainer is integral on the optional unit.

2. The floating connector according to claim 1, wherein the holder comprises:

a first part arranged on one side of the retainer along the urging direction and configured to support the connector; and a second part arranged on the other side of the retainer along the urging direction opposite from the first part and configured to be movable integrally with the first part.

3. The floating connector according to claim 2, wherein the holder-side positioning section is arranged in the second part; and wherein the urging member urges the first part in a direction to be farther from the retainer.

4. The floating connector according to claim 3, wherein the urging member is arranged between the retainer and the first part.

5. The floating connector according to claim 1, wherein the retainer comprises a third part, the third part being arranged on a side of the holder closer to the connector, and a fourth part, the fourth part being arranged on an opposite side of the holder farther from the connector.

6. The floating connector according to claim 5, wherein the retainer-side positioning section is arranged in the third part, and the urging member urges the holder toward the third part of the retainer.

7. The floating connector according to claim 6, wherein the urging member is arranged between the holder and the fourth part.

8. The floating connector according to claim 1, wherein at least one of the retainer-side positioning section and the holder-side positioning section comprises an inclined surface, which inclines with respect to the urging direction of the urging member.

9. The floating connector according to claim 8, wherein each of the retainer-side positioning section and the holder-side positioning section is formed in a ring shape.

10. The floating connector according to claim 9, wherein the holder-side positioning section comprises a holder-side engageable part, the holder-side engageable part being configured to engage with a retainer-side engageable part, which is arranged in the retainer-side positioning section, along a rotatable direction of the holder being rotatable about a center of the retainer-side positioning section.

11. The floating connector according to claim 10, wherein each of the retainer-side positioning section and the holder-side positioning section comprises the inclined surface; and wherein each of the holder-side engageable part and the retainer-side engageable part is formed in a shape of one of a projection, which protrudes from the inclined surface of the holder-side positioning section and the retainer-side positioning section respectively, and a dent, which dents from the inclined surface of the holder-side positioning section and the retainer-side positioning section respectively.

12. The floating connector according to claim 1, wherein the urging member comprises a plurality of urging members; and wherein the plurality of urging members are arranged in positions, between which the connector is interposed, in a view along the urging direction of the urging member.

13. The floating connector according to claim 12, wherein the urging member comprises a plurality of urging members; and wherein the plurality of urging members are arranged in positions to encircle the connector in the view along the urging direction of the urging member.

14. An image forming apparatus, comprising:

a main body comprising an image forming unit;

an optional unit configured to be attachable to the main body; and a floating connector disposed on the optional unit, the floating connector comprising, a connector, a holder configured to support the connector, a retainer configured to retain the holder floating, the retainer comprising a retainer-side positioning section, and an urging member configured to urge the holder, wherein the holder comprises a holder-side positioning section, the holder-side positioning section configured to locate the holder in a predetermined position with respect to the retainer by contacting the retainer-side positioning section, wherein the holder-side positioning section of the holder is urged by the urging member to contact the retainer-side positioning section of the retainer, and wherein one of the holder and the retainer is configured to be arranged on both sides of the other of the holder and the retainer along an urging direction of the urging member, and the one of the holder and the retainer that is arranged on both sides of the other of the holder and the retainer is integral on the optional unit.

15. The image forming apparatus according to claim 14, wherein the main body is provided with a pair of openings at a fixing part, at which the optional unit overlaps the main body;

wherein the optional unit comprises a pair of inserting members, the pair of inserting members being configured to be inserted in the pair of openings to place the optional unit in a predetermined position with respect to the main body; and wherein the connector is arranged in a position to align with the pair of inserting members.

16. The image forming apparatus according to claim 15, wherein the main body comprises a pair of attaching members, the pair of attaching members forming rims of the pair of openings; and wherein a mating connector to be connected with the connector is disposed on one of the pair of attaching members.

17. The floating connector according to claim 1, wherein the urging member urges the holder in a direction to be farther from the retainer, while the holder-side positioning section of the holder being urged is moved to fit closer with the retainer-side positioning section.

18. The image forming apparatus according to claim 14, wherein the urging member urges the holder in a direction to be farther from the retainer, while the holder-side positioning section of the holder being urged is moved to fit closer with the retainer-side positioning section.

* * * * *